US009466308B2

(12) United States Patent
Choo et al.

(10) Patent No.: US 9,466,308 B2
(45) **Date of Patent: *Oct. 11, 2016**

(54) METHOD FOR ENCODING AND DECODING AN AUDIO SIGNAL AND APPARATUS FOR SAME

(71) Applicant: SAMSUNG ELECTRONICS CO., LTD., Suwon-si (KR)

(72) Inventors: Ki Hyun Choo, Yongin-si (KR); Jung-Hoe Kim, Yongin-si (KR); Eun Mi Oh, Yongin-si (KR); Ho Sang Sung, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/579,706

(22) Filed: Dec. 22, 2014

(65) Prior Publication Data

US 2015/0154975 A1 Jun. 4, 2015

Related U.S. Application Data

(63) Continuation of application No. 13/254,119, filed as application No. PCT/KR2010/000495 on Jan. 27, 2010, now Pat. No. 8,918,324.

(30) Foreign Application Priority Data

Jan. 28, 2009 (KR) ..... 10-2009-0006668
Jan. 26, 2010 (KR) ..... 10-2010-0007067

(51) Int. Cl.

| | |
|---|---|
| ***G10L 19/00*** | (2013.01) |
| ***G10L 21/00*** | (2013.01) |
| ***G10L 19/02*** | (2013.01) |

(Continued)

(52) U.S. Cl.
CPC ..... *G10L 19/20* (2013.01); *G10L 19/12* (2013.01)

(58) Field of Classification Search
CPC ..... H05K 999/99; G10L 25/90; G10L 25/93; G10L 15/08; G10L 19/06; G10L 19/008; G10L 21/04; G10L 19/005; G10L 19/10; G10L 19/12; G10L 21/0208; G10L 19/0212; H04B 1/665
See application file for complete search history.

(56) References Cited

U.S. PATENT DOCUMENTS 5,875,423 A * 2/1999 Matsuoka ..... G10L 19/18 704/220
6,968,309 B1 * 11/2005 Makinen ..... G10L 19/005 704/206

(Continued)

FOREIGN PATENT DOCUMENTS

| | | | |
|---|---|---|---|
| CN | 1192563 | A | 9/1998 |
| CN | 101025918 | A | 8/2007 |
| KR | 10-2008-0027129 | A | 3/2008 |

OTHER PUBLICATIONS

Communication, dated Jun. 1, 2015, issued by the State Intellectual Property Office of P.R. China in counterpart Chinese Application No. 201080014179.6.

(Continued)

*Primary Examiner* — Pierre-Louis Desir
*Assistant Examiner* — Anne Thomas-Homescu
(74) *Attorney, Agent, or Firm* — Sughrue Mion, PLLC

(57) ABSTRACT

A method for coding and decoding an audio signal or speech signal and an apparatus adopting the method are provided.

8 Claims, 10 Drawing Sheets

(51) Int. Cl.

| | |
|---|---|
| ***G10L 25/90*** | (2013.01) |
| ***G10L 25/93*** | (2013.01) |
| ***G10L 19/12*** | (2013.01) |
| ***G10L 21/04*** | (2013.01) |
| ***G10L 19/20*** | (2013.01) |

(56) References Cited

U.S. PATENT DOCUMENTS 7,315,815 B1 * 1/2008 Gersho ..... G10L 19/173 704/223
7,933,769 B2 * 4/2011 Bessette ..... G10L 19/0208 375/240.13
8,224,659 B2 * 7/2012 Lee ..... G10L 19/093 704/206
8,494,865 B2 * 7/2013 Fuchs ..... G10L 19/0017 704/500
8,762,159 B2 * 6/2014 Geiger ..... 704/500
8,781,843 B2 * 7/2014 Oh ..... G10L 19/20 704/201
2002/0029141 A1 * 3/2002 Cox ..... G10L 21/0208 704/220
2005/0261900 A1 * 11/2005 Ojala ..... G10L 19/22 704/223
2005/0267742 A1 * 12/2005 Makinen ..... G10L 19/022 704/219
2006/0047523 A1 * 3/2006 Ojanpera ..... G10L 19/0208 704/503
2006/0100859 A1 * 5/2006 Jelinek ..... G10L 19/24 704/201
2006/0100885 A1 * 5/2006 Oh ..... G10L 21/04 704/503
2006/0271357 A1 * 11/2006 Wang ..... G10L 19/005 704/223
2007/0016405 A1 * 1/2007 Mehrotra ..... G10L 19/025 704/203
2007/0083362 A1 * 4/2007 Moriya ..... H03M 7/30 704/219
2007/0094017 A1 * 4/2007 Zinser, Jr. ..... G10L 19/173 704/219
2007/0174051 A1 * 7/2007 Oh ..... G10L 19/22 704/211
2007/0179783 A1 * 8/2007 Manjunath ..... G10L 19/20 704/230
2007/0282603 A1 * 12/2007 Bessette ..... G10L 19/0208 704/219
2008/0040121 A1 * 2/2008 Wang ..... G10L 19/005 704/500
2008/0077412 A1 3/2008 Oh et al.
2009/0006086 A1 * 1/2009 Yamanashi ..... G10L 19/24 704/225
2009/0024396 A1 * 1/2009 Lee ..... G10L 19/093 704/500
2009/0030703 A1 * 1/2009 Liebchen ..... G10L 19/12 704/500
2009/0063139 A1 * 3/2009 Tammi ..... G10L 19/08 704/207
2009/0106032 A1 * 4/2009 Liebchen ..... G10L 19/12 704/500
2009/0299757 A1 * 12/2009 Guo ..... G10L 19/18 704/500
2009/0306992 A1 * 12/2009 Ragot ..... G10L 19/26 704/500
2009/0313011 A1 * 12/2009 Chon ..... G10L 19/025 704/230
2009/0319262 A1 * 12/2009 Gupta ..... G10L 25/90 704/207
2009/0319263 A1 * 12/2009 Gupta ..... G10L 19/10 704/229
2010/0017202 A1 * 1/2010 Sung ..... G10L 19/20 704/208
2010/0070285 A1 * 3/2010 Kim ..... G10L 19/20 704/500
2010/0088089 A1 * 4/2010 Hardwick ..... G10L 13/02 704/208
2010/0094642 A1 * 4/2010 Zhan ..... G10L 19/005 704/500
2010/0114568 A1 * 5/2010 Yoon ..... G10L 19/18 704/223
2010/0145688 A1 * 6/2010 Sung ..... G10L 19/20 704/208
2010/0145714 A1 * 6/2010 Zhou ..... G11B 20/10527 704/500
2010/0280822 A1 * 11/2010 Yoshida ..... G10L 19/008 704/201
2010/0312551 A1 * 12/2010 Oh ..... G10L 19/20 704/203
2010/0312567 A1 * 12/2010 Oh ..... G10L 19/20 704/500
2010/0318349 A1 * 12/2010 Kovesi ..... G10L 19/005 704/207
2011/0173008 A1 * 7/2011 Lecomte ..... G10L 19/20 704/500
2011/0173009 A1 * 7/2011 Fuchs ..... G10L 19/20 704/500
2011/0173010 A1 * 7/2011 Lecomte ..... G10L 19/20 704/500
2011/0173011 A1 * 7/2011 Geiger ..... G10L 19/04 704/500
2011/0238426 A1 * 9/2011 Fuchs ..... G10L 19/0017 704/500
2012/0296641 A1 * 11/2012 Rajendran ..... G10L 21/038 704/206
2013/0096930 A1 * 4/2013 Neuendorf ..... G10L 19/008 704/500
2013/0173272 A1 * 7/2013 Wu ..... G10L 19/0212 704/500
2013/0253922 A1 * 9/2013 Ehara ..... G10L 19/005 704/219
2014/0032213 A1 * 1/2014 Kim ..... G10L 19/12 704/219
2014/0156287 A1 * 6/2014 Koishida ..... G10L 19/167 704/500

OTHER PUBLICATIONS

International Search Report for PCT/KR2010/000495 issued Sep. 10, 2010 [PCT/ISA/210].

Communication issued Jul. 25, 2012 by the European Patent Office in counterpart European Application No. 10736005.9.

Neuendorf, Max et al. "Detailed Technical Description of Reference Model 0 of the CFP on Unified Speech and Audio Coding (USAC)", Oct. 9, 2008, No. M15867, XP030044464.

Communication, dated Jan. 30, 2013, issued by the State Intellectual Property Office of P.R. China in counterpart Chinese Application No. 201080014179.6.

International Organisation for Standardisation ISO/IEC JTC1/SC29/WG11 MPEG2008/M 15867 Oct. 2008.

Communication dated Jul. 1, 2016 issued by Korean Intellectual Property Office in counterpart Korean Application No. 10-2016-0059791.

* cited by examiner

FIG. 9

| Value | window_sequence | num_windows | looks like |
|---|---|---|---|
| 0 | ONLY_LONG_SEQUENCE = LONG_WINDOW | 1 | |
| 1 | LONG_START_SEQUENCE = LONG_START_WINDOW | 1 | |
| 2 | EIGHT_SHORT_SEQUENCE = 8 * SHORT_WINDOW | 8 | |
| 3 | LONG_STOP_SEQUENCE = LONG_STOP_WINDOW | 1 | |
| 1 | STOP_START_SEQUENCE = STOP_START_WINDOW | 1 | |
| 3 | LPD_START_SEQUENCE = START_WINDOW_LPD | 1 | |
| 3 | STOP_1152_SEQUENCE = STOP_WINDOW_1152 | 1 | |
| 1 | STOP_START_1152_SEQUENCE = STOP_START_WINDOW_1152 | 1 | |

FIG. 10

| Value | window_sequence | num_windows | looks like |
|---|---|---|---|
| 0 | ONLY_LONG_SEQUENCE = LONG_WINDOW | 1 | |
| 1 | LONG_START_SEQUENCE = LONG_START_WINDOW | 1 | |
| 2 | EIGHT_SHORT_SEQUENCE = 8 * SHORT_WINDOW | 8 | |
| 3 | LONG_STOP_SEQUENCE = LONG_STOP_WINDOW | 1 | |
| 4 | STOP_START_SEQUENCE = STOP_START_WINDOW | 1 | |
| 5 | LPD_START_SEQUENCE = START_WINDOW_LPD | 1 | |
| 6 | STOP_1152_SEQUENCE = STOP_WINDOW_1152 | 1 | |
| 7 | STOP_START_1152_SEQUENCE = STOP_START_WINDOW_1152 | 1 | |

METHOD FOR ENCODING AND DECODING AN AUDIO SIGNAL AND APPARATUS FOR SAME

CROSS-REFERENCE TO RELATED APPLICATIONS

This is a continuation application of U.S. patent application Ser. No. 13/254,119, filed on Aug. 31, 2011, in the U.S. Patent and Trademark Office, which is a National Stage of International Application No. PCT/KR2010/000495, filed Jan. 27, 2010, which claims priority from Korean Patent Application No. 10-2009-0006668, filed on Jan. 28, 2009 and Korean Patent Application No. 10-2010-0007067, filed on Jan. 26, 2010, in the Korean Intellectual Property Office, the disclosures of which are incorporated herein by reference in their entireties.

TECHNICAL FIELD

Example embodiments relate to a method of coding and decoding an audio signal or speech signal and an apparatus for accomplishing the method.

BACKGROUND ART

An audio signal performs coding and decoding generally in a frequency domain, for example, advanced audio coding (AAC). For example, AAC codec performs the modified discrete cosine transform (MDCT) for transformation to the frequency domain, and performs frequency spectrum quantization using a signal masking level in an aspect of psychoacoustic technology. Lossless coding is applied to further compress the quantization result. The AAC uses Huffman coding for the lossless coding. The bit-sliced arithmetic coding (BSAC) codec which applies arithmetic coding, may also be used instead of the Huffman coding for the lossless coding.

A speech signal is coded and decoded generally in a time domain. Mostly, a speech codec performing coding in the time domain is a code excitation linear prediction (CELP) type. The CELP refers to a speech coding technology. Currently, G.729, AMR-NB, AMR-WB, iLBC EVRC, and the like are generally used as the CELP-based speech coding apparatus. The coding method is developed under the presumption that a speech signal can be obtained through linear prediction (LP). When coding speech signals, an LP coefficient and an excitation signal are necessary. Usually, the LP coefficient may be coded using a line spectrum pair (LSP) while the excitation signal may be coded using several codebooks. The CELP-based coding method includes algebraic CELP (ACLEP), conjugate structure (CS)-CELP, and the like.

In an aspect of limit of transmission rate and psychoacoustics, a low frequency band and a high frequency band have a difference in sensitivity. The low frequency band is sensitive to fine structures on a speech/sound frequency. The high frequency band is less sensitive to the fine structures than the low frequency band. Based on this theory, the low frequency band is allocated with a great number of bits to code the fine structures in detail whereas the high frequency band is allocated with fewer bits than the low frequency band and performs coding. According to such a technology, such as spectral band replication (SBR), in the low frequency band, fine structures are coded in detail using a codec such as the AAC and, in the high frequency band, the fine structures are expressed by energy information and regulatory information. The SBR copies low frequency signals in a quadrature mirror filter (QMF) domain, thereby generating high frequency signals.

A bit reduction method is also applied to a stereo signal. More specifically, the stereo signal is converted to a mono signal, and a parameter expressing stereo information is extracted. Next, the stereo parameter and the mono signal compressed data are transmitted. Therefore, a decoding apparatus may decode the stereo signal using the transmitted parameter. For the compression of stereo information, a parametric stereo (PS) may be used. Also, a moving picture expert group surround (MPEGS) technology may be used to extract and transmit a parameter of a multichannel signal.

Objects of the lossless coding will be descried in further detail. The lossless coding may be performed, by regarding a quantization index of the quantized spectrum as one symbol. Also, coding may be performed by mapping the quantized spectrum index on a bit plane and collecting bits.

When context-based lossless coding is performed, information of a previous frame may be used. When the decoding apparatus does not have the information on the previous frame, a lossless decoding apparatus may perform wrong decoding or, even worse, the system may stop. For example, in digital audio broadcasting that applies an audio coding and decoding apparatus, a listener may turn on a radio and start listening at a random time. During the random access to an audio stream, the decoding apparatus needs information on the previous frame for precise decoding. However, reproduction is difficult due to lack of the previous frame information.

DISCLOSURE OF INVENTION

Technical Goals

Example embodiments provide a speech audio coding apparatus that codes an input signal by selecting one of frequency domain coding or linear prediction domain (LPD) coding in a low frequency band, using algebraic code excited linear prediction (ACELP) or transform coded excitation (TCX) for the LPD coding, and by enhanced spectral band replication (eSBR) in a high frequency band.

Effects

According to an aspect, redundant bit information for decoding may be reduced when coding an audio signal or speech signal.

According to another aspect, calculation of a decoding apparatus may be reduced, by referring to specific bit information for decoding at the beginning of decoding of the audio signal or speech signal.

In addition, according to another aspect, decoding is available regardless of random access to the audio signal or speech signal.

BRIEF DESCRIPTION OF DRAWINGS

FIG. 9 illustrates a related art example of a definition of window_sequence; and FIG. 10 illustrates a definition of window_sequence according to an exemplary embodiment.

BEST MODE FOR CARRYING OUT THE INVENTION

According to example embodiments, a coding and decoding method for an audio signal or speech signal may achieve a codec by partly combining tools of enhanced advanced audio coding (EAAC) pulse codec standardized by 3GPP and AMR-WB+ codec.

Figure 1:
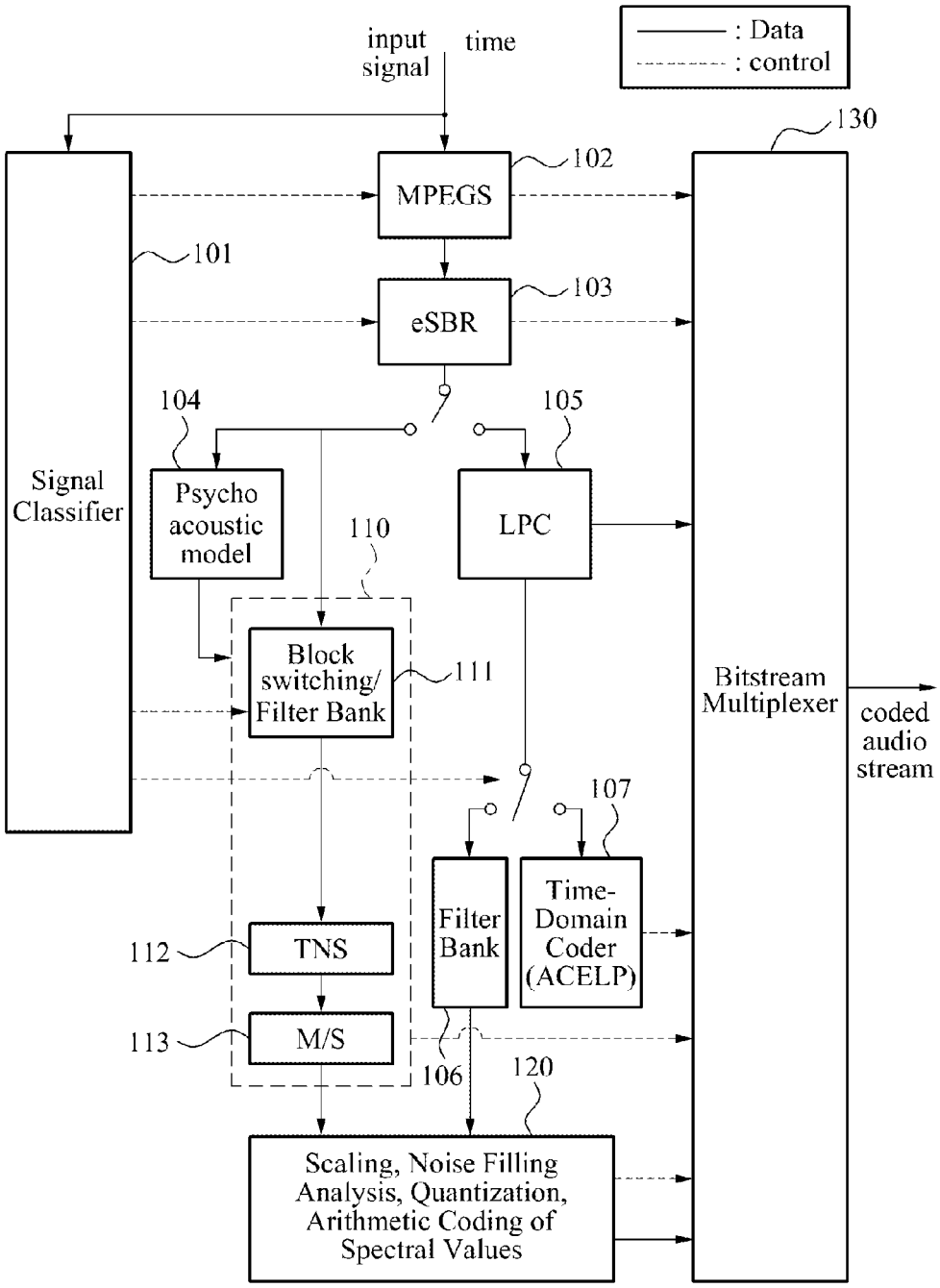
FIG. 1 illustrates a block diagram showing a coding apparatus for an audio signal or speech signal, according to example embodiments.

FIG. 1 illustrates a block diagram showing a coding apparatus for an audio signal or speech signal, according to example embodiments.

EAAC+ is standardized based on an ACC codec, a spectral band replication (SBR), and parametric stereo (PS) technologies. Here, the AMR-WB+ applies a code excitation linear prediction (CELP) codec and transform coded excitation (TCX) scheme to code a low frequency band, and applies a bandwidth extension (BWE) scheme to code a high frequency band. Also, a linear prediction (LP)-based stereo technology may be applied.

In the coding apparatus shown in FIG. 1, a signal of the low frequency band is coded by a core coding apparatus while a signal of the high frequency band is coded by enhanced SBR (eSBR) 103. A signal of a stereo band may be coded by moving picture expert group surround (MPEGS) 102.

The core coding apparatus that codes the low frequency domain signal may operate in two coding modes, that is, a frequency domain (FD) coding mode and an LP domain (LPD) coding mode.

The core coding apparatus 102 and 103 for coding the low frequency band signal may select whether to use a frequency domain coding apparatus 110 or using an LPD coding apparatus 105, according to a signal through a signal classifier 101. For example, the cord coding apparatus may switch such that an audio signal such as a music signal is coded by the frequency domain coding apparatus 110 and that a speech signal is coded by the LPD coding apparatus 105. Coding mode information determined by the switching is stored in the bit stream. When the coding mode is switched to the frequency domain coding apparatus 110, coding is performed through the frequency domain coding apparatus 110.

The operation of the core coding apparatus may be expressed by syntax as follows.

| Syntax | No. of bits |
|---|---|
| single_channel_element( ) | |
| { | |
| Core_mode | 1 |
| if ( core_mode == 1 ) { | |
| lpd_channel_stream( ); | |
| } | |
| else { | |
| fd_channel_stream(0,0,noiseFilling); | |
| } | |
| } | |

The frequency domain coding apparatus 110 may perform a transformation according to a length of a window appropriate for signals in a block switching/filter bank module 111. The Modified discrete cosine transform (MDCT) may be used for the transformation. The MDCT, that is a critically sampled transformation, may perform about 50% overlapping and generate a frequency coefficient corresponding to half a length of the window. For example, when a length of one frame used in the frequency domain coding apparatus 110 is 1024, a window having a 2048 sample length, that is double an amount of a 1024 sample, may be used. In addition, the 1024 sample may be divided into 8 so that the MDCT of a 256 length window is performed eight times. According to a transformation of a core coding mode, a 1152 frequency coefficient may be generated using a 2304 length window.

Transformed frequency domain data may apply temporal noise shaping (TNS) 112 as necessary. The TNS 112 refers to a method for performing LP in a frequency domain. The TNS 112 is usually applied when a signal has a strong attack due to duality between a time domain and a frequency domain. For example, a strong attack signal in the time domain may be expressed as a relatively flat signal in the frequency domain. When LP is performed with the signal, coding efficiency may be increased.

When a signal processed by the TNS 112 is a stereo signal, Mid Side (M/S) stereo coding 113 may be applied. When a stereo signal is coded by a left signal and a right signal, the coding efficiency may decrease. In this case, the stereo signal may be transformed to have a high coding efficiency using a sum and a difference of the left signal and the right signal.

The signal passed through the frequency transformation, the TNS, and the M/S stereo coding may be quantized, generally using a scalar quantizer. When scalar quantization is uniformly applied throughout the frequency band, a dynamic range of a quantization result may excessively increase, thereby deteriorating a quantization characteristic. To prevent this, the frequency band is divided based on a psychoacoustic model 104, which is defined as a scale factor band. Quantization may be performed by providing scaling information to each scale factor band and calculating a scaling factor in consideration of a used bit quantity based on the psychoacoustic model 104. When data is quantized to zero, the data is expressed as zero even after decoding. As more data quantized to zero exists, distortion of decoded signal may increase. To reduce the signal distortion, a function of adding noise during decoding may be performed. Therefore, the coding apparatus may generate and transmit information on the noise.

Lossless coding is performed to the quantized data. A lossless coding apparatus 120 may apply context arithmetic coding. The lossless coding apparatus 120 may use, as context, spectrum information of a previous frame and spectrum information decoded so far. The lossless coded spectrum information may be stored in the bit stream, along with the previous calculated scaling factor information, noise information, TNS information, M/S information, and the like.

When the core coding apparatus switches to the LPD coding apparatus 105, coding may be performed by dividing one super frame into a plurality of frames and selecting a coding mode of each frame as ACELP 107 or TCX 106. For example, one super frame may include the 1024 sample and another super frame may include four 256 samples. One frame of the frequency domain coding apparatus 110 may have the same length as one super frame of the LPD coding apparatus 105.

When selecting the coding mode between the ACELP and the TCX, a closed loop method and an open loop method may be used. According to the closed loop method, ACELP coding and TCX coding are tried first and the coding mode is selected using a measurement such as signal-to-noise ratio (SNR). According to the open loop method, the coding mode is determined by understanding a characteristic of the signal.

An example of conventional syntax expressing the operation of the LPD coding apparatus 105 is shown below.

```
Syntax                                                    No. of bits
lpd_channel_stream( )
{
  acelp_core_mode                                         3
  lpd_mode                                                5
  First_tcx_flag=TRUE;
  k = 0;
  if (first_lpd_flag) { last_lpd_mode = 0; }
  while (k < 4) {
    if (mod[k] == 0) {
      acelp_coding(acelp_core_mode);
      last_lpd_mode=0;
      k += 1;
    }
    else {
      tcx_coding( lg(mod[k], last_lpd_mode) , first_tcx_flag);
      last_lpd_mode=mod[k];
      k += 2^(mod[k]-1);
      first_tcx_flag=FALSE;
    }
  }
  lpc_data(first_lpd_flag)
}
```

In case of the ACELP, coding is performed by selecting one of several fixed bit allocation modes. In this case, the bit allocation mode is included in the bit stream. In a case of TCX, since coding is performed by a variable bit allocation mode, bit allocation information is unnecessary.

The foregoing will be explained more specifically in the following.

According to the TCX scheme, an excitation signal remaining after the LP is transformed to the frequency domain, and coding is performed in the frequency domain. Transformation to the frequency domain may be performed by the MDCT. According to the LP coding, coding is performed in units of a super frame that includes four frames. With respect to the four frames, mode information indicating a coding mode between the ACELP and the TCX of each frame needs to be transmitted. When the mode information is the ACELP, since used bit rate needs to be constant with respect to one frame, information on the used bit rate is included in the bit stream being transmitted. The TCX includes three modes according to a transformation length. In the LP coding mode, the ACELP includes a plurality of modes according to the used bit rate.

Examples of the bit allocation mode related to the ACELP and the TCX mode explained above are shown in Table 1 and Table 2 below.

TABLE 1

| | meaning of bits in bit-field mode | | | | | remaining |
|---|---|---|---|---|---|---|
| lpd_mode | bit 4 | bit 3 | bit 2 | bit 1 | bit 0 | mod[ ] entries |
| 0 . . . 15 | 0 | mod[3] | mod[2] | mod[1] | mod[0] | |
| 16 . . . 19 | 1 | 0 | 0 | mod[3] | mod[2] | mod[1] = 2<br>mod[0] = 2 |
| 20 . . . 23 | 1 | 0 | 1 | mod[1] | mod[0] | mod[3] = 2<br>mod[2] = 2 |
| 24 | 1 | 1 | 0 | 0 | 0 | mod[3] = 2<br>mod[2] = 2<br>mod[1] = 2<br>mod[0] = 2 |
| 25 | 1 | 1 | 0 | 0 | 1 | mod[3] = 3<br>mod[2] = 3<br>mod[1] = 3<br>mod[0] = 3 |
| 26 . . . 31 | | | | | | reserved |

TABLE 2

| value of mod[x] | coding mode in frame | bitstream element |
|---|---|---|
| 0 | ACELP | acelp_coding( ) |
| 1 | one frame of TCX | tcx_coding( ) |
| 2 | TCX covering half a superframe | tcx_coding( ) |
| 3 | TCX covering entire superframe | tcx_coding( ) |

For example, the TCX includes three modes according to the transformation length. As shown in Table 1, according to the three modes, (1) one frame is coded by the TCX, (2) a half of one super frame is coded by the TCX, and (3) the whole super frame is coded by the TCX. Here, lpd_mode may be structured as shown in Table 1. For example, when lpd_mode is 0, it is expressed as 00000 in order from bit 4 to bit 0. This means that all frames in one super frame are coded by the ACELP, as shown in Table 1.

Among 26 lpd_modes shown in Table 1, the ACELP is not used in 5 cases, that is, 15, 19, 23, 24, and 25. That is, when the lpd_modes are 15, 19, 23, 24, and 25, only the TCX but the ACELP is used in one super frame.

Therefore, when the ACELP is not used in a current super frame, transmission of acelp_core_mode is not required. In this case, whether to further analyze acelp_core_mode information is determined, including an operation of generating of information that the ACELP is not used or only the TCX is used in one super frame. That is, when only the TCX is used in one super frame, the bit allocation information of the ACELP is not included in the bit stream. The bit allocation information of the ACELP is included in the bit stream only when the ACELP is used in at least one frame. Accordingly, size of the coded audio signal or speech signal may be reduced.

Example syntax describing an operation of the LPD coding apparatus capable of reducing the bit allocation information of the ACELP is shown below.

```
Syntax                                                    No. of bits
lpd_channel_stream( )
{                                                         5
  lpd_mode
```

-continued

| Syntax | No. of bits |
|---|---|
| if( is_tcx_only(lpd_mode) == 0 ) | |
| acelp_core_mode | 3 |
| first_tcx_flag=TRUE; | |
| k = 0; | |
| if (first_lpd_flag){ last_lpd_mode = 0; } | |
| while (k < 4) { | |
| if (mod[k] == 0) { | |
| acelp_coding(acelp_core_mode); | |
| last_lpd_mode=0; | |
| k += 1; | |
| } | |
| else { | |
| tcx_coding( lg(mod[k], last_lpd_mode) , first_tcx_flag); | |
| last_lpd_mode=mod[k]; | |
| k += 2^(mod[k]-1); | |
| first_tcx_flag=FALSE; | |
| } | |
| } | |
| lpc_data(first_lpd_flag) | |
| } | |

When the TCX is selected, an excitation signal is extracted by performing LP with respect to a time domain signal. The extracted excitation signal is transformed to a frequency domain. For example, the MDCT may be applied. The frequency-transformed excitation signal is normalized by one global gain and then scalar quantized. Lossless coding is performed to the quantized index information, that is, quantized data. A lossless coding apparatus may apply context arithmetic coding. The lossless coding apparatus may use, as context, spectrum information of a previous frame and spectrum information decoded so far. The lossless coded spectrum information may be stored in the bit stream, along with the global gain, LP coefficient information, and the like. The stored bit stream may be output as a coded audio stream through a bit stream multiplexer 130.

Figure 2:
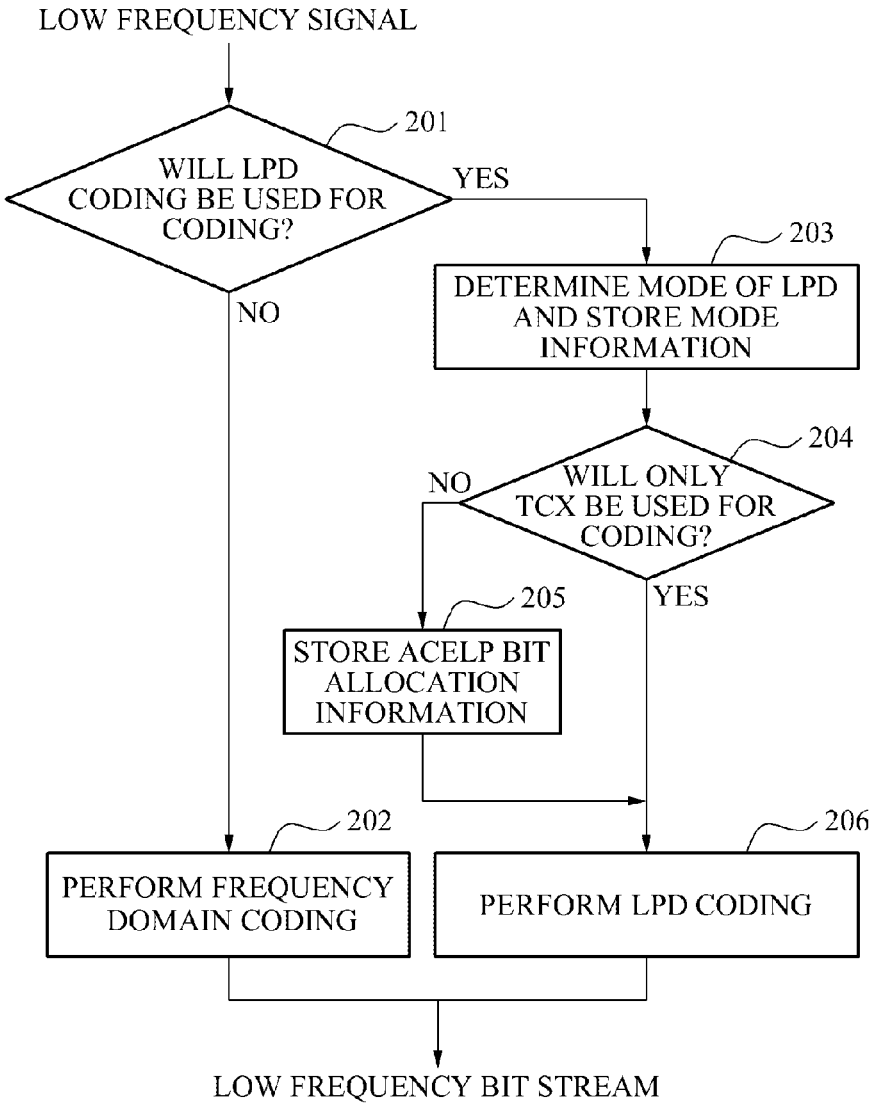
FIG. 2 illustrates a flowchart showing an example coding method performed by a coding apparatus for an audio signal or speech signal, according to example embodiments.

FIG. 2 illustrates a flowchart showing an example coding method performed by a coding apparatus for an audio signal or speech signal, according to example embodiments.

Referring to FIG. 2, it is determined whether an input low frequency signal will be coded by LPD coding in operation 201. When the LPD coding is used as a determination result of operation 201, a mode the LPD coding is determined and the mode information is stored in operation 203. It is determined whether to use only the TCX for coding in operation 204, and the LPD coding is performed when only the TCX will be used, in operation 206. When coding is performed not only by the TCX as a determination result of operation 204, the bit allocation information of the ACELP is stored and the LPD coding of operation 206 is performed.

When it is determined that the LPD coding is not used in operation 201, frequency domain coding is performed in operation 202.

Figure 3:
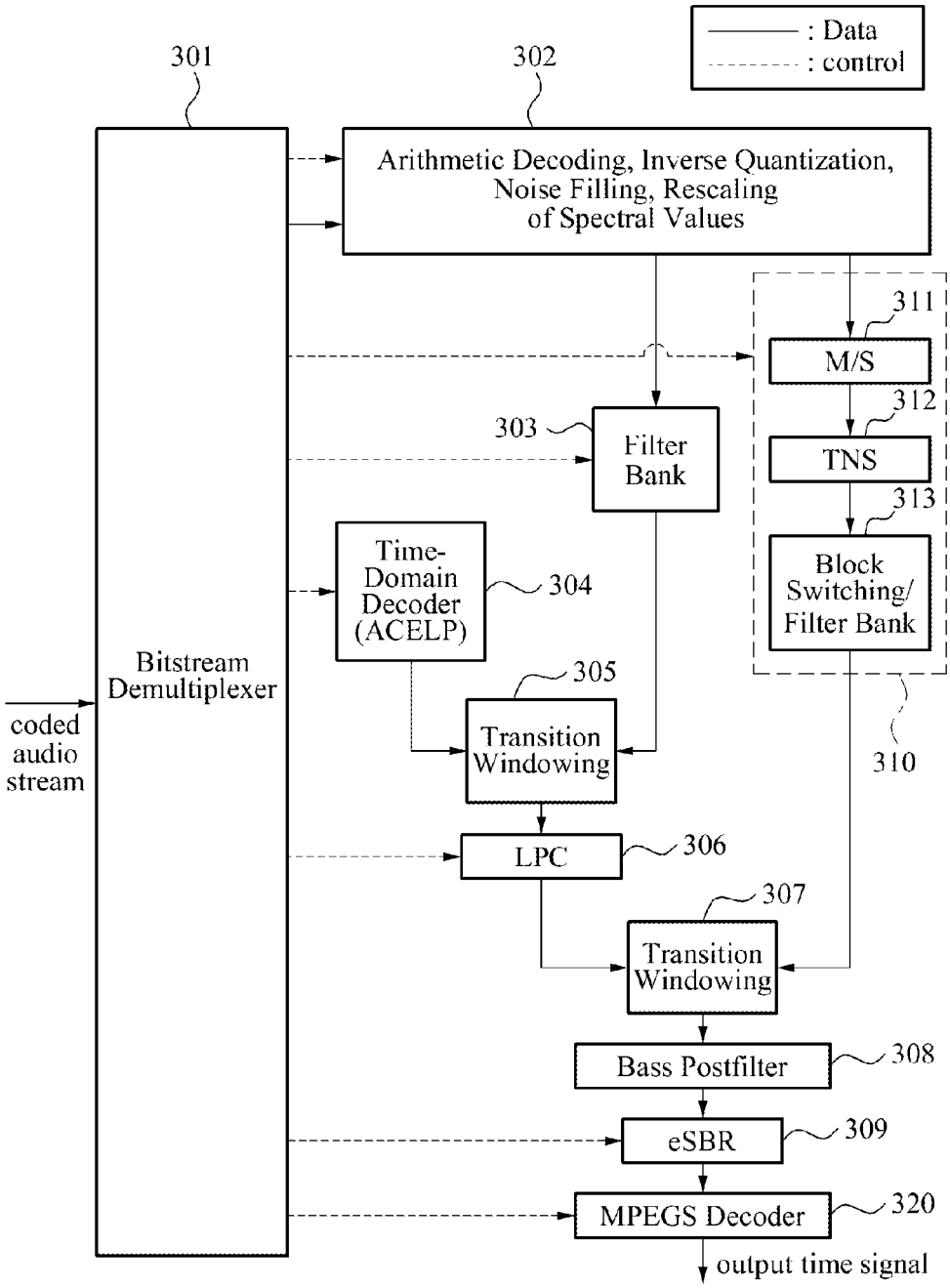
FIG. 3 illustrates a block diagram showing a decoding apparatus for an audio signal or speech signal, according to example embodiments.

FIG. 3 illustrates a block diagram showing a decoding apparatus for an audio signal or speech signal, according to example embodiments.

Referring to FIG. 3, the decoding apparatus includes a bit stream demultiplexer 301, a calculation decoding unit 302, a filter bank 303, a time domain decoding unit (ACELP) 304, transition window units 305 and 307, a linear prediction coder (LPC) 306, a bass postfilter 308, an eSBR 309, an MPEGS decoder 320, an M/S 311, a TNS 312, a block switching/filter bank 313. The decoding apparatus may decode an audio signal or speech signal decoded by the decoding apparatus shown in FIG. 1 or the decoding method shown in FIG. 2.

The decoding apparatus shown in FIG. 3 may decode in the frequency domain when coding is performed by the frequency domain coding mode, based on the coding mode information. When coding is performed by the LPD coding mode, the decoding apparatus may decode by a mode corresponding to the coding mode based on information on whether the CELP or the TCX is used with respect to each frame of one super frame.

A core decoding method in the decoding apparatus shown in FIG. 3 may be expressed by syntax as follows.

| Syntax | No. of bits |
|---|---|
| single_channel_element( ) | |
| { | |
| Core_mode | 1 |
| if ( core_mode == 1 ){ | |
| lpd_channel_stream( ); | |
| } | |
| else { | |
| fd_channel_stream(0,0,noiseFilling); | |
| } | |
| } | |

Based on information determined from the syntax, when the frequency domain coding is applied, frequency domain decoding is performed. The frequency domain decoding recovers the spectrum losslessly coded and quantized through scale factor information and arithmetic coding, dequantizes the quantized spectrum, and generates a spectrum by multiplying a scale factor. The spectrum is changed using the TNS and the M/S information based on the generated spectrum, accordingly generating a recovered spectrum. Noise may be added when necessary. A final core time domain signal is generated by dequantizing the recovered spectrum. The MDCT may be applied for the dequantization.

The frequency domain decoding method may be expressed by syntax shown below.

| Syntax | No. of bits |
|---|---|
| fd_channel_stream(common_ window, common_tw, noiseFilling) | |
| { | |
| global_gain; | 8 |
| if (noiseFilling) { | |
| Noise_offset | 3 |
| Noise_level | 5 |
| } | |
| else { | |
| noise_level = 0 | |
| } | |
| if (!common_window) { | |
| ics_info( ); | |
| } | |
| if (tw_mdct) { | |
| if ( !common_tw ) { | |
| Tw_data( ); | |
| } | |
| } | |
| scale_factor_data ( ); | |
| tns_data_present; | 1 |
| if (tns_data_present) { | |
| tns_data ( ); | |
| } | |
| ac_spectral_data ( ); | |
| } | |

A method of determining a core coding mode with respect to a coded low frequency band signal by the decoding apparatus may be expressed by syntax shown below.

| Syntax | No. of bits |
|---|---|
| lpd_channel_stream( ) | |
| { | |
| lpd_mode | 5 |
| if( is_tcx_only(lpd_mode) == 0 ) | |
| acelp_core_mode | 3 |
| first_tcx_flag=TRUE; | |
| k = 0; | |
| if (first_lpd_flag) { last_lpd_mode = 0; } | |
| while (k < 4) { | |
| if (mod[k] == 0) { | |
| acelp_coding(acelp_core_mode); | |
| last_lpd_mode=0; | |
| k += 1; | |
| } | |
| else { | |
| tcx_coding( lg(mod[k], last_lpd_mode) , first_tcx_flag); | |
| last_lpd_mode=mod[k]; | |
| k += 2^(mod[k]-1); | |
| first_tcx_flag=FALSE; | |
| } | |
| } | |
| lpc_data(first_lpd_flag) | |
| } | |

The coding mode information of the LPD (lpd_mode) includes information on composition of the ACELP and the TCX of one super frame. When only the TCX is used, ACELP decoding is not performed although the ACELP bit allocation information (acelp_core_mode) is not included in the bit stream. Therefore, decoding is available. Therefore, by reading information that the ACELP is not used in one super frame or that only the TCX is used, it is determined whether to additionally analyze the ACELP bit allocation information (acelp_core_mode). When it is determined that only the TCX is used, TCX decoding is performed with respect to the super frame. When the ACELP is included, after the ACELP bit allocation information (acelp_core_mode) is additionally analyzed, ACELP or TCX decoding may be performed.

Thus, a decoded low frequency signal is generated by analyzing the bit stream of the coded audio signal or speech signal, thereby confirming whether coding is performed by the LPD coding, and performing frequency domain decoding when the LPD coding is not used. When the LPD coding is used, the coding mode of the LPD is analyzed and, when only the TCX is used as a result of the analysis, the LPD decoding is performed. When at least one frame is coded by the ACELP coding, the bit allocation information of the ACELP is analyzed and the LPD decoding is performed.

When the LPD coding is performed, decoding is performed corresponding to the coding mode information that is the ACELP or the TCX, of respective four frames included in one super frame. According to the TCX, an arithmetic coded spectrum is generated and a transmitted global gain is multiplied, thereby generating a spectrum. The generated spectrum is dequantized by inverse MDCT (IMDCT). LP synthesis is performed based on a transmitted LP coefficient, thereby generating a core decoded signal. According to the ACELP, an excitation signal is generated based on an index and gain information of adaptive and innovation codebook. LP synthesis is performed with respect to the excitation signal, thereby generating a core decoded signal.

Figure 4:
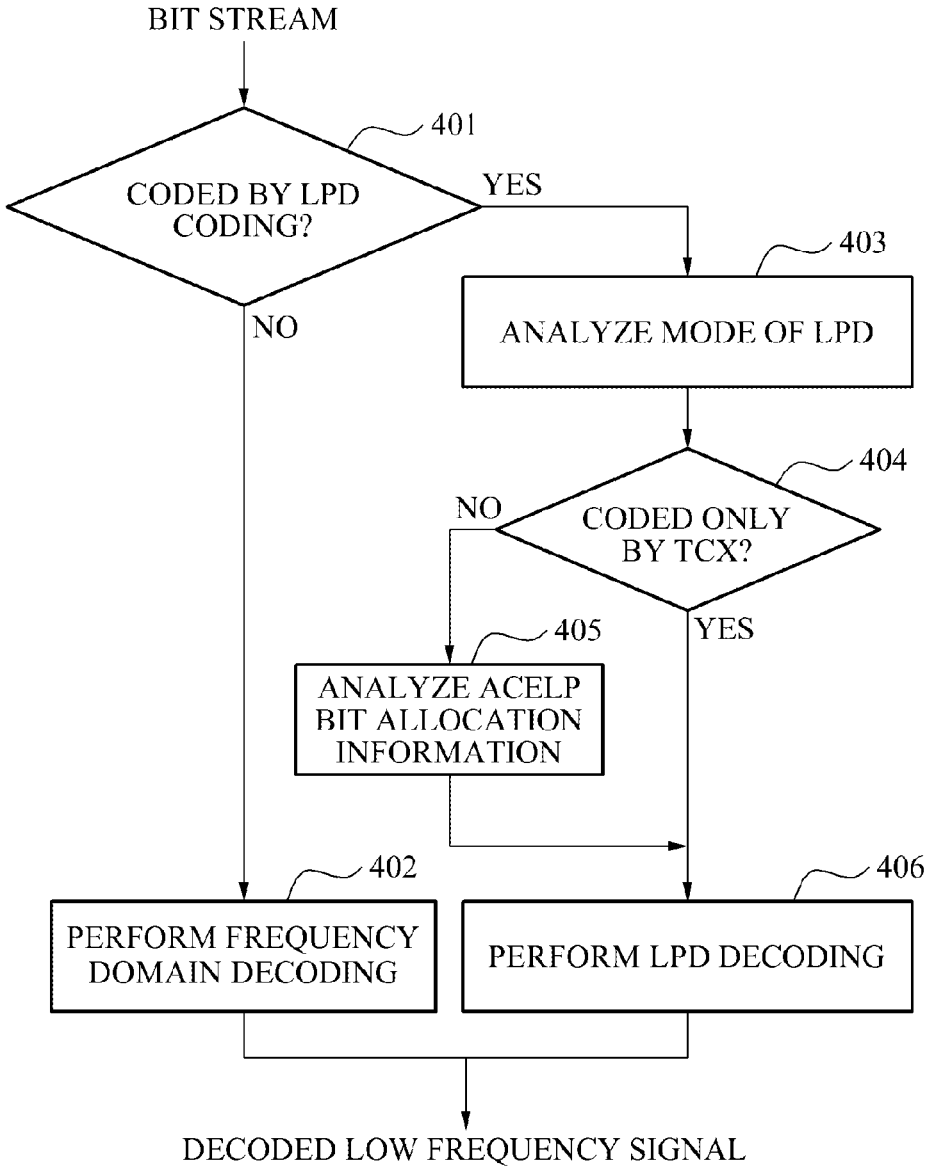
FIG. 4 illustrates a flowchart showing an example of a decoding method performed by a decoding apparatus for an audio signal or speech signal, according to example embodiments.

FIG. 4 illustrates a flowchart showing an example of a decoding method performed by a decoding apparatus for an audio signal or speech signal, according to example embodiments.

Referring to FIG. 4, it is determined whether an input bit stream is coded by the LPD coding in operation 401. As a result of operation 401, when the LPD coding is performed, a mode of the LPD is analyzed in operation 403. In operation 404, it is determined whether only TCX is used for coding. When only the TCX coding is used, the LPD decoding is performed in operation 406. As a result of operation 404, when coding is performed by not only the TCX, the ACELP bit allocation information is analyzed and the LPD decoding of operation 406 is performed.

When the LPD is not used for coding in operation 401, frequency domain decoding is performed in operation 402.

Hereinafter, a decoding apparatus and method according to other example embodiments will be described with reference to FIGS. 5 to 7.

Figure 5:
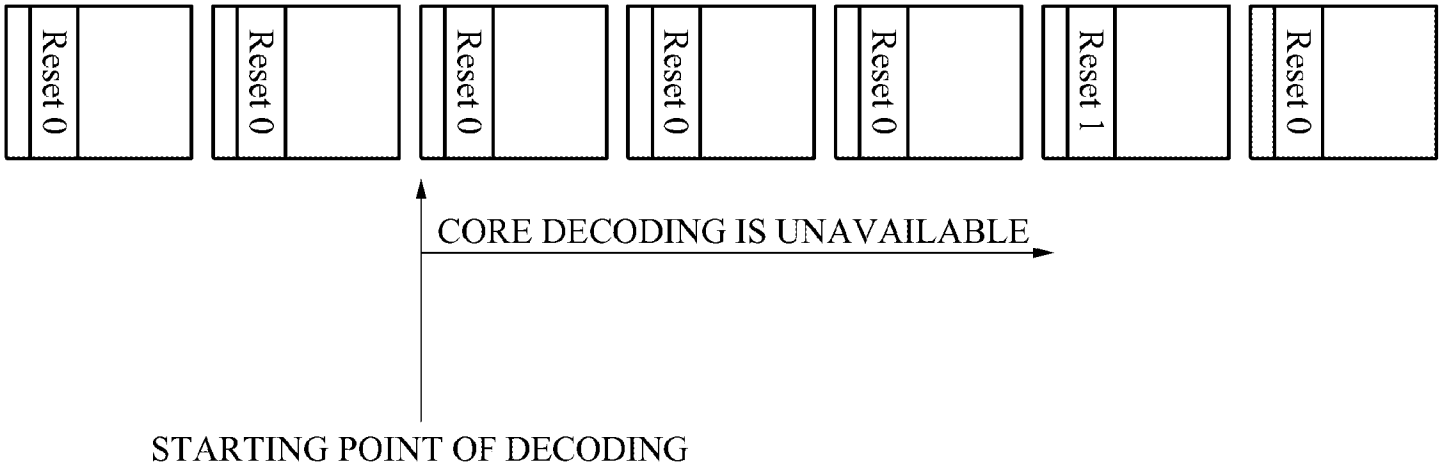
FIG. 5 illustrates a diagram of an example of a bit stream of a coded audio signal or speech signal, for explaining a decoding method according to other example embodiments.

FIG. 5 illustrates a diagram of an example of a bit stream of a coded audio signal or speech signal, for explaining a decoding method according to other example embodiments.

FIG. 5 shows an example where a context reset flag is applied. The context reset flag is applied to AAC/TCX entropy coding. Arithmetic coding context is syntax to indicate a reset. The context reset flag is periodically set to 1 so that context reset is performed. According to the conventional AAC, since decoding is performed with each frame, decoding may be started at a random point of time during broadcasting. However, in a case of MPEG unified speech and audio codec (USAC), since a previous frame is used as context, decoding of a current frame is unavailable if the previous frame is not decoded.

Therefore, when a user makes a random access to a certain position of the coded audio signal or speech signal for reproduction, it is necessary to determine a setting state of the context reset flag of a frame to be decoded corresponding to the position, in other words, determine whether decoding of the current frame is available.

Figure 6:
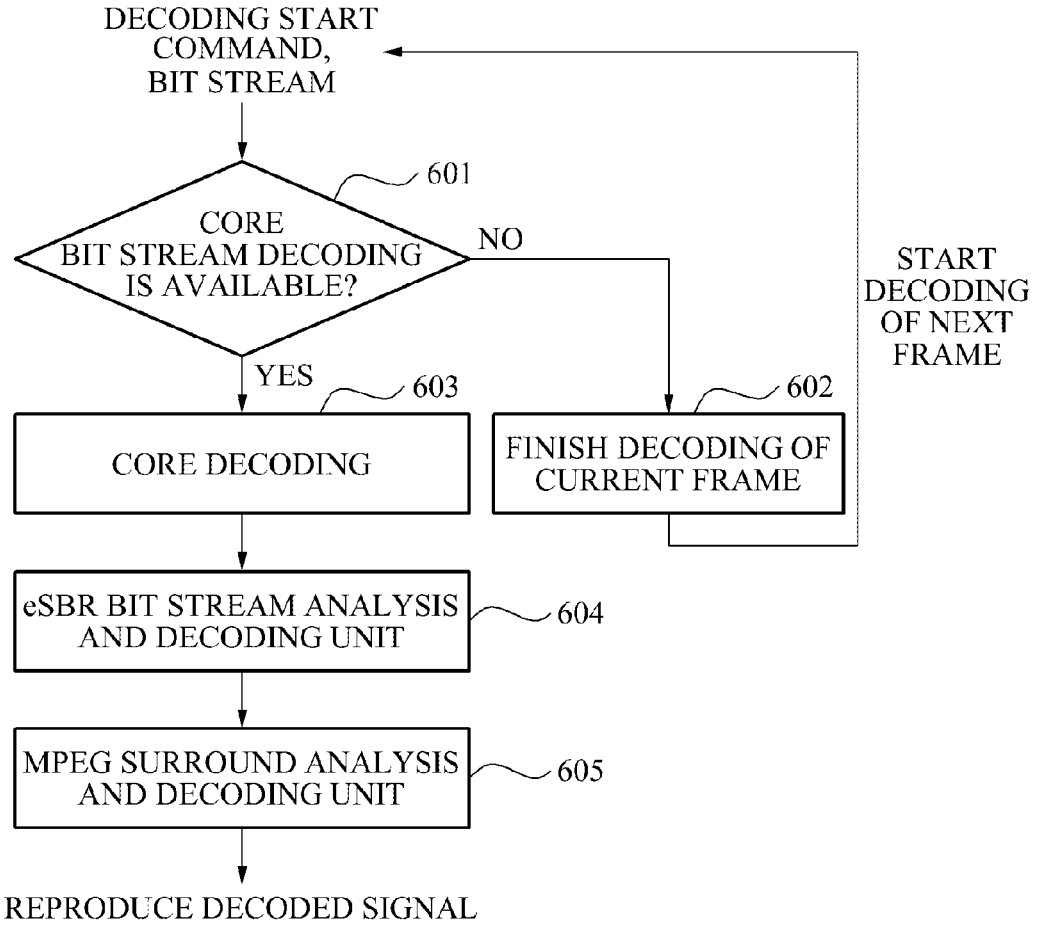
FIG. 6 illustrates a flowchart showing a decoding method for a coded audio signal or speech signal, according to other example embodiments.

FIG. 6 illustrates a flowchart showing a decoding method for a coded audio signal or speech signal, according to other example embodiments.

Referring to FIG. 6, a decoding start command of a user with respect to an input bit stream is received. It is determined whether core bit stream decoding of the bit stream is available in operation 601. When the core bit stream decoding is available, core decoding is performed in operation 603. eSBR bit stream analysis and decoding are performed in operation 604, and MPEGS analysis and decoding are performed in operation 605. When the core bit stream decoding is unavailable in operation 601, decoding of the current frame is finished in operation 602. It is determined whether core decoding with respect to a next frame is available. During this operation, when a decodable frame is detected, decoding may be performed from the frame. Availability of the core decoding may be determined according to whether information on the previous frame may be referred to. Reference availability of the information on the previous frame may be determined according to whether to reset context information of the arithmetic coding, that is, by reading the arith_reset_flag information.

A decoding method according to other example embodiments may be expressed by syntax as follows.

| Syntax | No. of bits |
|---|---|
| single_channel_element( ) | |
| { | |
| core_mode | 1 |
| if ( core_mode == 1 ) { | |
| lpd_channel_stream( ); | |
| } | |

-continued

| Syntax | No. of bits |
|---|---|
| else { | |
| fd_channel_stream(0,0,noiseFilling); | |
| } | |
| } | |

| Syntax | No. of bits |
|---|---|
| channel_pair_element( ) | |
| { | |
| core_mode0 | 1 |
| core_mode1 | 1 |
| if (core_mode0 == 0 && core_mode1 == 0) { | |
| common_window; | 1 |
| if (common_window) { | |
| ics_info( ); | |
| ms_mask_present; | 2 |
| if ( ms_mask_present == 1 ) { | |
| for (g = 0; g < num_window_groups; g++) { | |
| for (sfb = 0; sfb < max_sfb; sfb++) { | |
| ms_used[g][sfb]; | 1 |
| } | |
| } | |
| } | |
| } | |
| if (tw_mdct) { | |
| common_tw; | 1 |
| if ( common_tw ) { | |
| tw_data( ); | |
| } | |
| } | |
| } | |
| else { | |
| common_window = 0; | |
| common_tw = 0; | |
| } | |
| if ( core_mode0 == 1 ) { | |
| lpd_channel_stream( ); | |
| } | |
| else { | |
| fd_channel_stream(common_window, common_tw, noiseFilling); | |
| } | |
| if ( core_mode1 == 1) { | |
| lpd_channel_stream( ); | |
| } | |
| else { | |
| fd_channel_stream(common_window, common_tw, noiseFilling); | |
| } | |
| } | |

Referring to the syntax above, when information on only one channel is included in the bit stream, decoding is performed using single_channel_element. When decoding is performed with information of two channels simultaneously, channel_pair_element is used. Whether it is the frequency domain or the LPD is determined by analyzing the core coding mode (core_mode). In a case of the channel_pair_element, since the information on two channels is included, two core coding information modes exist.

Based on the foregoing, when the frequency domain coding is performed, whether to perform decoding is analyzed first by resetting the context, and then the frequency domain decoding may be performed.

Example syntax expressing the abovementioned method is shown below.

| Syntax | No. of bits |
|---|---|
| fd_channel_stream(common_window, common_tw, noiseFilling) | |
| { | |
| arith_reset_flag | 1 |
| global_gain; | 8 |
| if (noiseFilling) { | |
| noise_offset | 3 |
| noise_level | 5 |
| } | |
| else { | |
| noise_level = 0 | |
| } | |
| if (lcommon_window) { | |
| ics_info( ); | |
| } | |
| if (tw_mdct) { | |
| if ( l common_tw ) { | |
| tw_data( ); | |
| } | |
| } | |
| scale_factor_data ( ); | |
| tns_data_present; | 1 |
| if (tns_data_present) { | |
| tns_data ( ); | |
| } | |
| ac_spectral_data (arith_reset_flag); | |
| } | |
| ac_spectral_data(arith_reset_flag) | |
| { | |
| for (win = 0; win < num_windows; win++) { | |
| arith_data(num_bands, arith_reset_flag) | |
| } | |
| } | |

Referring to the syntax, arith_reset_flag precedes the syntax. When arith_reset_flag is set, that is, when the context is reset, the frequency domain decoding is performed. When the contact is not reset, the current frame may not be decoded.

Figure 7:
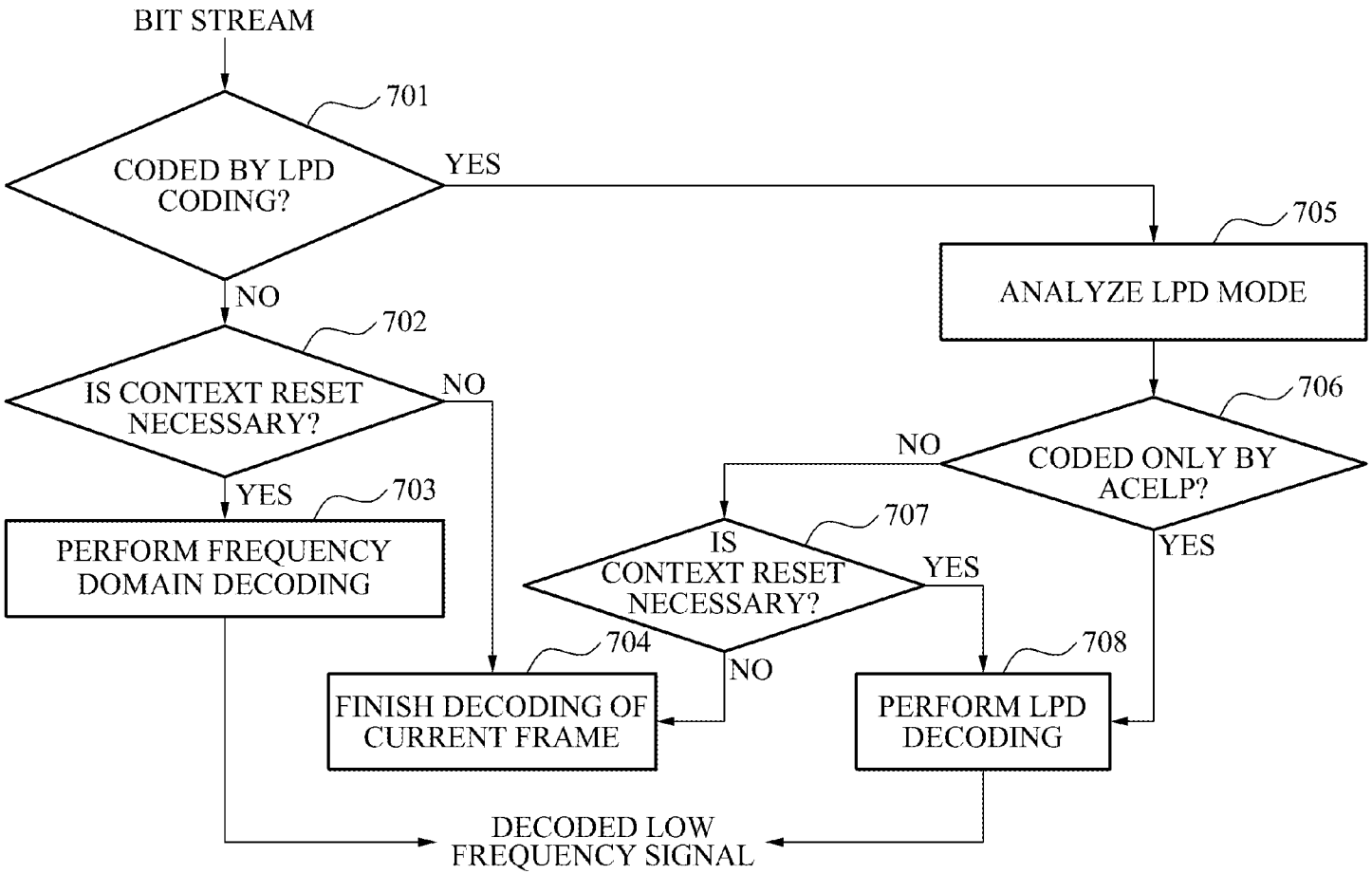
FIG. 7 illustrates a flowchart showing a decoding method performed by a decoding apparatus according to example embodiments, by determining a decoding mode between frequency domain decoding and linear prediction domain (LPD) decoding.

FIG. 7 illustrates a flowchart showing a decoding method performed by a decoding apparatus according to example embodiments, by determining frequency domain decoding or linear prediction domain (LPD) decoding.

Referring to FIG. 7, it is determined whether an input coded bit stream is frequency domain decoded or LPD decoded in operation 701. Also, the frequency domain decoding or the LPD decoding is performed according to the determination result.

When the frequency domain decoding is performed as a result of operation 701, whether context is reset is determined first in operation 702. When the context reset is required, decoding of a current frame is started in operation 703. When the context reset is not performed, decoding of the current frame is finished in operation 704 and the determination is performed with respect to a next frame.

When the LPD decoding is performed, that is, when the bit stream LPD coded, an LP coding mode in one super frame is determined in operation 705. Whether at least one TCX is used is determined based on the determination in operation 706. When the TCX is used, it is analyzed whether to reset corresponding context in operation 707. When the context needs reset as a determination result of operation 707, decoding is performed from a current frame in operation 708. When the context reset is not performed, decoding of the current frame is finished in operation 704 and the determination is performed with respect to a next frame.

As described in the foregoing, when the LPD mode is 0, it means that only the ACELP is used. Therefore, when the LP coding mode (lpd_mode) has a value other than 0, it means that the at least one TCX is used. When the TCX is used at least once, information on whether to reset the context is included in the coded bit stream. Here, in case of the ACELP that does not use the context of a previous frame, decoding may be performed irrespective of whether to reset context information of arithmetic coding.

In the decoding apparatus according to the example embodiments, operation efficiency may be maximized using arith_reset_flag with respect to context reset, included in a frame using the TCX.

When the decoding apparatus performs the LPD decoding by analyzing the input bit stream, a method expressed by syntax below may be used.

| Syntax | No. of bits |
|---|---|
| lpd_channel_stream( ) | |
| { | |
| acelp_core_mode | 3 |
| lpd_mode | 5 |
| If (lpd_mode l= 0) | |
| arith_reset_flag | 1 |
| k = 0; | |
| if (first_lpd_flag) { last_lpd_mode = 0; } | |
| while (k < 4) { | |
| if (mod[k] == 0) { | |
| acelp_coding(acelp_core_mode); | |
| last_lpd_mode=0; | |
| k += 1; | |
| } | |
| else { | |
| tcx_coding( lg(mod[k], last_lpd_mode) , arith_reset_flag); | |
| last_lpd_mode=mod[k]; | |
| k += 2^(mod[k]-1); | |
| arith_reset_flag = FALSE; | |
| } | |
| } | |
| lpc_data(first_lpd_flag) | |
| } | |
| tcx_coding(lg, arith_reset_flagfirst_tcx_flag) | |
| { | |
| noise_factor | 3 |
| global_gain | 7 |
| if (first_tcx_flag ) { | |
| arith_reset_flag | 1 |
| } | |
| else { | |
| arith_reset_flag=0 | |
| } | |
| arith_data(lg, arith_reset_flag) | |
| } | |

To summarize, according to the frequency domain decoding without adopting the decoding method according to the example embodiments, parsing of all data before spectral data is required to determine whether the context is reset. According to the TCX without adopting the decoding method according to the example embodiments, all data needs to be decoded according to composition of ACELP/TCX to determine whether the context is reset. This is because information such as a scale factor is necessary for determining the context reset. However, since a first bit is arith_reset_flag in case of the AAC and the context reset state is determined by parsing first 6 bits and reading arith_reset_flag value in case of the LPD mode, the decoding method according to the example embodiments may determine decoding availability of a frame without decoding all frames. As a result, the operation efficiency of the decoding apparatus may be maximized.

A coding apparatus according to other example embodiments may perform coding by further including information on whether random access to a current frame is available.

Figure 8:
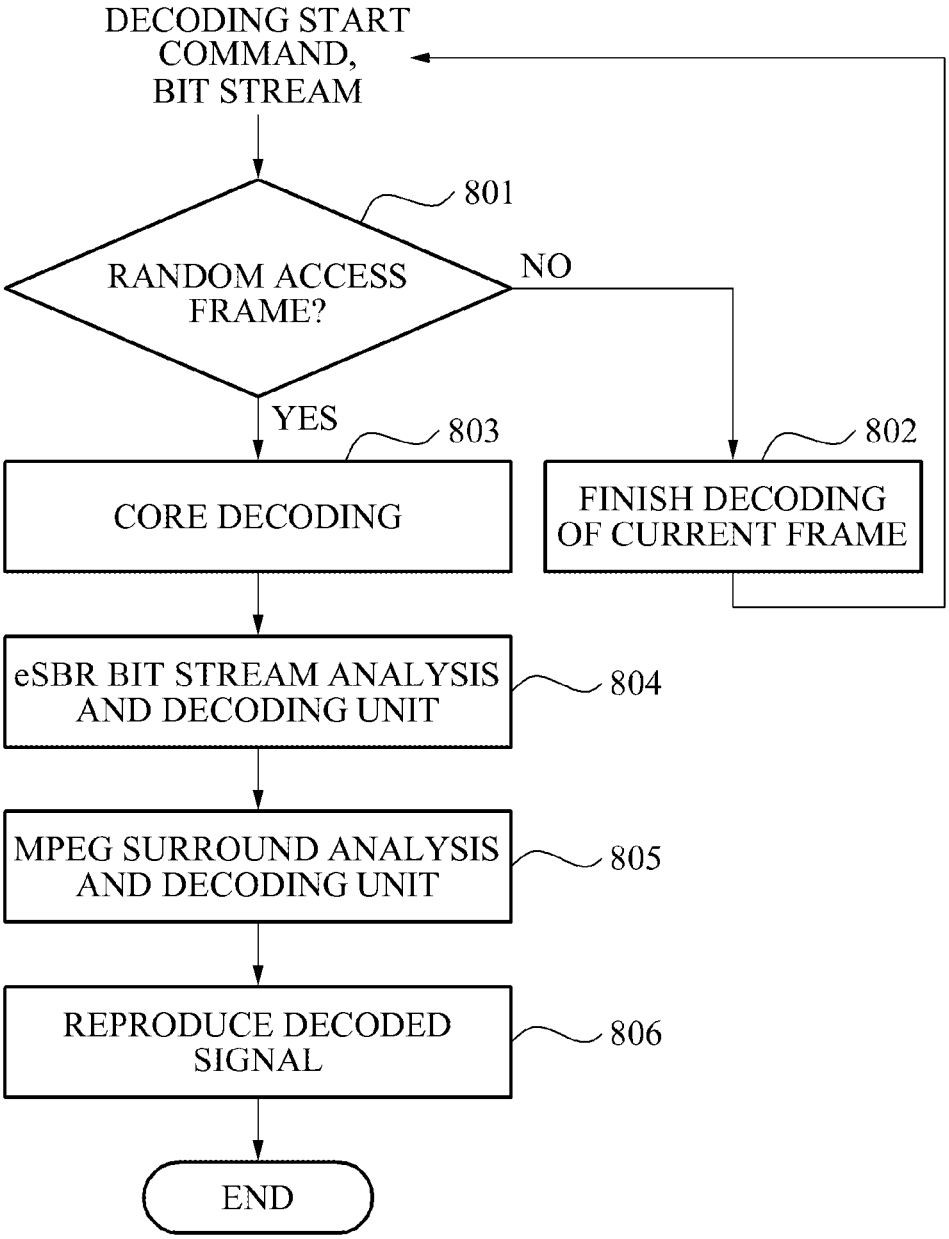
FIG. 8 illustrates a flowchart showing a core decoding method performed by a decoding apparatus according to example embodiments.

FIG. 8 illustrates a flowchart showing a core decoding method performed by a decoding apparatus according to example embodiments.

Referring to FIG. 8, when a user intends to decode a coded audio signal or speech signal at a random time, the coding apparatus determines whether decoding of a current frame is available, by receiving a coded bit stream and determining whether random access to the frame is available in operation 801, and then performs core decoding in operation 803. When the core decoding is unavailable, decoding availability of a next frame is determined. When a decodable frame is detected during this, decoding may be performed from the frame. Availability of the decoding may be determined according to whether random access to the current frame is available.

After the core coding of operation 803, eSBR bit stream analysis and decoding is performed in operation 804 and MPEG analysis and decoding is performed in operation 805. Next, the decoded signal is reproduced in operation 806.

The frequency domain coding includes in total 8 information of a window type. The 8 types may be expressed by 2 bits according to a core coding mode and the window type of a previous frame. In this case, when information on the core coding mode of the previous frame does not exist, decoding is unavailable. To prevent this, information on whether the frame is randomly accessible may be added, and window_sequence information may be expressed in another way using the added information.

The window_sequence information refers to information necessary to understand a number of spectrums and perform dequantization. With respect to a frame not allowing random_access, the window_sequence information may be expressed by 2 bits according to a conventional method. With respect to a frame allowing random_access, since context reset is necessary for decoding arith_reset_flag is always set to 1. In this case, arith_reset_flag does not have to be separately included and transmitted.

Syntax below is an original syntax described with reference to FIG. 6.

| Syntax | No. of bits |
|---|---|
| single_channel_element( ) | |
| { | |
| core_mode | 1 |
| if ( core_mode == 1 ) { | |
| lpd_channel_stream( ); | |
| } | |
| else { | |
| fd_channel_stream(0,0,noiseFilling); | |
| } | |
| } | |

Additionally, syntax below is a revised syntax according to a modified embodiment.

| Syntax | No. of bits |
|---|---|
| single_channel_element( ) | |
| { | |
| random_access | 1 |
| core_mode | 1 |
| if ( core_mode == 1 ) { | |
| lpd_channel_stream(random_access) | |
| } | |
| else { | |
| fd_channel_stream(random_access,0,0, | |
| } | |
| } | |

As shown in the syntax above, random_access field (1 bit) may be added.

When a flag value of the random_access field is set, the window_sequence information for decoding may be expressed differently.

Syntax corresponding to the above is introduced below.

```
Syntax                                                    No. of bits
channel_pair_element( )
{
  random_access                                           1
  core_mode0                                              1
  core_mode1                                              1
    if (core_mode0 == 0 && core_mode1 == 0) {
      common_window;
      if (common_window) {                                1
        ics_info(random_access);
        ms_mask_present;                                  2
        if ( ms_mask_present == 1 ) {
          for (g = 0; g < num_window_groups; g++) {
            for (sfb = 0; sfb < max_sfb; sfb++) {
              ms_used[g][sfb];                            1
            }
          }
        }
    }
    if (tw_mdct) {
        Common_tw;                                        1
        if ( common_tw ) {
          tw_data( );
        }
    }
  }
  else {
    common_window = 0;
    common_tw = 0;
  }
  if ( core_mode0 == 1 ) {
    lpd_channel_stream(random_access);
  }
    else {
        fd_channel_stream(random_access,common_window,
        common_tw, noiseFilling);
    }
  if ( core_mode1 == 1 ) {
    lpd_channel_stream(random_access);
  }
    else {
fd_channel_stream(random_access,common_window,
        common_tw, noiseFilling);
    }
}
```

In the syntax above, fd_channel_stream may be expressed as follows.

```
Syntax                                                    No. of bits
fd_channel_stream(random_access, common_window,
common_tw, noise Filling)
{
  global_gain;                                            8
  if (noiseFilling) {
    noise_offset                                          3
    noise_level                                           5
  }
  else {
    noise_level = 0
  }
  if (lcommon_window) {
    ics_info(random_access);
  }
  if (tw_mdct) {
    if ( l common_tw ) {
      tw_data( );
    }
  }
  scale_factor_data ( );
```

-continued

```
Syntax                                                    No. of bits
  tns_data_present;                                       1
  if (tns_data_present) {
    tns_data ( );
  }
  ac_spectral_data (random_access);
}
```

In the syntax above, fd_channel_stream, ics_info may be expressed by syntax below. In the syntax below, 3 bits may be allocated for the window_sequence information.

```
Syntax                                                    No. of bits
ics_info(random_access)
{
  If (random_access == TRUE)
    window_sequence;                                      3
  else
    window_sequence;                                      2
  window_shape;                                           1
  if (window_sequence == EIGHT_SHORT_SEQUENCE) {
    max_sfb;                                              4
    scale_factor_grouping;                                7
  }
  else {
    max_sfb;                                              6
  }
}
```

When 3 bits are allocated for the window_sequence information as described above, the window_sequence may be defined as shown in FIG. 9

According to FIG. 9, there are three cases having value 1, that is, LONG_START_SEQUENCE, STOP_START_SEQUENCE, and STOP_START_1152_SEQUENCE. For example, in the case of STOP_START_1152_SEQUENCE, information that the previous frame is coded by the LPD is necessary for decoding. When a value is 3, information that the previous frame is coded by the LPD is also necessary for decoding.

Syntax shown in FIG. 10 is an example of the window_sequence information defined according to the example embodiments. The window_sequence information is expressed by sequentially allocating 8 values to 8 types of the window_sequence, but may be expressed in another way.

Also, as described in the foregoing, in the case of the random access frame, the context reset needs to be performed for decoding. Therefore, arith_reset_flag is always set to 1. In this case, arith_reset_flag does not need to be separately included and transmitted. Therefore, syntax described below with reference to FIG. 6 may be revised as follows.

<Original Syntax>

```
Syntax                                                    No. of bits
ac_spectral_data( )
{
  arith_reset_flag                                        1
  for (win = 0; win < num_windows; win++) {
    arith_data(num_bands, arith_reset_flag)
  }
}
```

<Example Revised Syntax>

| Syntax | No. of bits |
|---|---|
| ac_spectral_data(random_access) | |
| { | |
| if (random_access ==TRUE) | |
| arith_reset_flag = TRUE | |
| else | |
| arith_reset_flag | 1 |
| for (win = 0; win < num_windows; win++) { | |
| arith_data(num_bands, arith_reset_flag) | |
| } | |
| } | |

As described in the abovementioned, in the case of the random access frame, the context reset needs to be performed for decoding. Therefore, arith_reset_flag is always set to 1. In this case, arith_reset_flag does not need to be separately included and transmitted.

In the TCX as well, the random access frame cannot refer to a previous super frame. Therefore, transmission of arith_reset_flag of the random access frame may be omitted in the same manner as in the frequency domain decoding. Example syntax related to the TCX according to the method above may be expressed as follows.

<TCX Related Syntax According to Example Embodiments>

| Syntax | No. of bits |
|---|---|
| tcx_coding(random_access, lg, first_tcx_flag) | |
| { | |
| noise_factor | 3 |
| global_gain | 7 |
| if (first_tcx_flag ) { | |
| if (random_access=TRUE) { | |
| arith_reset_flag=TRUE | |
| } | |
| else { | |
| arith_reset_flag | 1 |
| } | |
| } | |

-continued

| Syntax | No. of bits |
|---|---|
| else { | |
| arith_reset_flag=0 | |
| } | |
| arith_data(lg, arith_reset_flag) | |
| } | |

According to other example embodiments, in case of the random access frame, the bit stream may include information on whether a current super frame is coded by the LPD coding. That is, with respect to the random access frame, the bit stream may include information (first_lpd_flag) on whether the previous frame is coded to the current frame by the frequency domain coding or LPD coding. When the TCX of the LPD coding is performed, core coding mode information used in coding the previous super frame is necessary for the decoding. However, since the number of dequantized spectrums of the TCX of the current super frame, that is, the number of transformed spectrums is known, the core coding mode information of the previous frame is necessary. Therefore, the syntax may additionally include the core coding mode information of the previous super frame, information on whether the current super frame is a first LP frame, or information on whether the previous super frame is the LP frame (first_lpd_flag). Information that the previous super frame is the LPD coded may be set to the code coding mode information (first_lpd_flag).

<Standard for Setting first_lpd_flag According to Example Embodiments>

| core_mode of previous frame (superframe) | core_mode of current frame (superframe) | first_lpd_flag |
|---|---|---|
| 0 | 1 | 1 |
| 1 | 1 | 0 |

<Syntax Including first_lpd_flag According to Example Embodiments>

| Syntax | No. of bits |
|---|---|
| lpd_channel_stream(random_access) | |
| { | |
| acelp_core_mode | 3 |
| lpd_mode | 5 |
| first_tcx_flag=TRUE; | |
| k = 0; | |
| if (random_access==TRUE) { | |
| first_lpd_flag | 1 |
| } | |
| if (first_lpd_flag) { last_lpd_mode = 0; } | |
| while (k < 4) { | |
| if (mod[k] == 0) { | |
| acelp_coding(acelp_core_mode); | |
| last_lpd_mode=0; | |
| k += 1; | |
| } | |
| else { | |
| tcx_coding(random_access, lg(mod[k], last_lpd_mode), first_tcx_flag); | |
| last_lpd_mode=mod[k]; | |
| k += 2^(mod[k]-1); | |
| first_tcx_flag=FALSE; | |
| } | |
| } | |
| lpc_data(first_lpd_flag) | |
| } | |

Transmission of the random access frame information described above may be varied according to the tool, that is, (1) the information may be transmitted to each random access frame, or (2) the information may be transmitted once to the whole payload of the USAC. For example, random access information related to a frequency domain coded part may be contained by declaring random_access to single_channel_element that contains the frequency domain information. Instead of the single_channel_element, random access related information may be included to a part containing the whole payload information of the USAC, to be applicable to all types of tools.

According to other example embodiments, in the case of eSBR, header information on existence of a header may be transmitted using 1 bit. Here, for decoding of the random access frame by itself, the header information needs to be transmitted. Therefore, parsing of the header information may be performed according to declaration of the random access. Specifically, the header is analyzed only when the random access is declared and is not analyzed when the random access is not declared. For this purpose, 1 bit of information regarding existence of the SBR header is prepared and transmitted only when the frame is not the random access frame. Accordingly, an unnecessary operation of header parsing may be omitted with respect to a non random access frame. Syntax regarding the process is shown below.

| Syntax | No. of bits |
|---|---|
| sbr_extension_data(id_aac, crc_flag; random_access) | |
| { | |
| num_sbr_bits = 0; | |
| if (crc_flag){ | |
| bs_sbr_crc_bits; | 10 |
| num_sbr_bits += 10; | |
| } | |
| if (sbr_layer l= SBR_STEREO_ENHANCE) { | |
| if (random_access==TRUE) | |
| num_sbr_bits += sbr_header( ); | |
| else { | |
| num_sbr_bits += 1; | |
| if (bs_header_flag) | 1 |
| num_sbr_bits += sbr_header( ); | |
| } | |
| } | |
| num_sbr_bits += sbr_data(id_aac, bs_amp_res); | |
| } | |

Referring to the syntax above, when random_access is true, bs_header_flag is set to true and SBR header is analyzed. When the random_access is false, information on whether SBR header information is necessary is transmitted. The SBR header analysis is not performed only when the SBR header information is necessary.

Hereinafter, various versions of the decoding method according to the example embodiments will be described in detail.

<Version 1: acelp_core_mode is Decoded in a First ACELP Frame by Adding first_acelp_flag>

Coding mode information of the LPD (lpd_mode) includes information on composition of the ACELP and the TCX of one super frame. Bit allocation information of the ACELP (acelp_core_mode) is necessary only when the ACELP is used. Therefore, only in this case, syntax may be structured to decode the acelp_core_mode information. The acelp_core_mode information is read when the frame is coded by the ACELP for the first time in the current super frame. With respect to a next frame coded by the ACELP next, the ACELP decoding may be performed based on the first read acelp_core_mode information, without reading the acelp_core_mode information.

The method above may be expressed by syntax below. Whether first_acelp_flag is 1 is read with respect to only the ACELP coded frame, when first_acelp_flag is 1, the ACELP bit allocation information is read by reading acelp_core_mode. Next, acelp_core_mode is set to 0. Therefore, the next ACELP coded frame may be decoded without reading acelp_core_mode.

| Syntax | No. of bits |
|---|---|
| lpd_channel_stream( ) | |
| { | |
| lpd_mode | 5 |
| first_tcx_flag=TRUE; | |
| first_acelp_flag=TRUE; | |
| k = 0; | |
| if (first_lpd_flag) { last_lpd_mode = 0; } | |
| while (k < 4) { | |
| if (mod[k] == 0) { | |
| if (first_acelp_flag) | |
| acelp_core_mode | 3 |
| acelp_coding(acelp_core_mode); | |
| last_lpd_mode=0; | |
| k += 1; | |
| first_acelp_flag=FALSE; | |
| } | |
| else { | |
| tcx_coding( lg(mod[k], last_lpd_mode), first_tcx_flag); | |
| last_lpd_mode=mod[k]; | |
| k += (1<<(mod[k]-1)); | |
| first_tcx_flag=FALSE; | |
| } | |
| } | |
| lpc_data(first_lpd_flag) | |
| } | |

<Version 2: Configuration where acelp_core_mode is not Decoded when Only the TCX is Used Through is_tcx_only( ), and Configuration where lpd_mode!=0 is Added and arith_reset_flag (Bit Reduction is 0) is Decoded>

The LPD coding mode information (lpd_mode) includes information on composition of the ACELP and the TCX of one super frame. When only the TCX is used, the ACELP decoding is not performed although the ACELP bit allocation information (acelp_core_mode) is not included in the bit stream. Therefore, decoding is available. Thus, by reading information that the ACELP is not used in one super frame or that only the TCX is used, it is determined whether to additionally analyze the ACELP bit allocation information (acelp_core_mode). When it is determined that only the TCX is used, TCX decoding is performed with respect to the super frame. When the ACELP is included, after the ACELP bit allocation information (acelp_core_mode) is additionally analyzed, ACELP or TCX decoding may be performed. In addition, when all frames in the super frame are decoded by the ACELP (lpd_mode=0), arith_reset_flag is unnecessary since the TCX decoding is not performed. Therefore, when lpd_mode is 0, the arith_reset_flag information is read and then the TCX decoding may be performed through tcx_coding( ). Here, since the arith_reset_flag information is information for resetting the context only in first first TCX frame in the super frame, decoding is performed by reading the arith_reset_flag and then resetting the arith_reset_flag to 0.

An example of syntax lpd_channel_stream( ) is shown below.

| Syntax | No. of bits |
|---|---|
| lpd_channel_stream( ) | |
| { | |
| lpd_mode | 5 |
| if (is_tcx_only(lpd_mode)==0) | |
| acelp_core_mode | 3 |
| if (lpd_model=0) | |
| arith_reset_flag | 1 |
| k = 0; | |
| if (first_lpd_flag) { last_lpd_mode = 0; } | |
| while (k < 4) { | |
| if (mod[k] == 0) { | |
| acelp_coding(acelp_core_mode); | |
| last_lpd_mode=0; | |
| k += 1; | |
| } | |
| else { | |
| tcx_coding( lg(mod[k], last_lpd_mode) , arith_reset_flag); | |
| last_lpd_mode=mod[k]; | |
| k += (1<<(mod[k]-1)); | |
| arith_reset_flag=0; | |
| } | |
| } | |
| lpc_data(first_lpd_flag) | |
| } | |

In addition, an example of syntax tcx_coding( ) is shown below.

| Syntax | No. of bits |
|---|---|
| tcx_coding(lg, arith_reset_flag) | |
| { | |
| noise_factor | 3 |
| global_gain | 7 |
| arith_data(lg, arith_reset_flag) | |
| } | |

<Version 3: Configuration where acelp_core_mode is Decoded in the First ACELP Frame by Adding first_acelp_flag, and Configuration where lpd_mode!=0 is Added and arith_reset_flag (Bit Reduction is 0) is Decoded>

Whether first_acelp_flag is 1 is determined only in the first frame coded by the ACELP. When first_acelp_flag is 1, acelp_core_mode is read, thereby reading the ACELP bit allocation information. Next, first_acelp_flag is set to 0. Therefore, the next ACELP coded frame may be decoded without reading acelp_core_mode. In addition, when all frames in the super frame are decoded by the ACELP (lpd_mode=0), arith_reset_flag is unnecessary since the TCX decoding is not performed. Therefore, when lpd_mode is 0, the arith_reset_flag information is read and then the TCX decoding may be performed through tcx_coding( ). Here, since the arith_reset_flag information is information for resetting the context only in first first TCX frame in the super frame, decoding is performed by reading the arith_reset_flag and then resetting the arith_reset_flag to 0.

An example of syntax lpd_channel_stream( ) is shown below.

| Syntax | No. of bits |
|---|---|
| lpd_channel_stream( ) | |
| { | |
| lpd_mode | 5 |
| if (lpd_model=0) | |
| arith_reset_flag | 1 |
| first_acelp_flag=TRUE; | |
| k = 0; | |
| if (first_lpd_flag) { last_lpd_mode = 0; } | |
| while (k < 4) { | |
| if (mod[k] == 0) { | |
| if (first_acelp_flag) | |
| acelp_core_mode | 3 |
| acelp_coding(acelp_core_mode); | |
| last_lpd_mode=0; | |
| k += 1; | |
| first_acelp_flag=FALSE; | |
| } | |
| else { | |
| tcx_coding( lg(mod[k], last_lpd_mode) , arith_reset_flag); | |
| last_lpd_mode=mod[k]; | |
| k += (1<<(mod[k]-1)); | |
| arith_reset_flag=0; | |
| } | |
| } | |
| lpc_data(first_lpd_flag) | |
| } | |

An example of syntax tcx_coding( ) is shown below.

| Syntax | No. of bits |
|---|---|
| tcx_coding(lg, arith_reset_flag) | |
| { | |
| noise_factor | 3 |
| global_gain | 7 |
| arith_data(lg, arith_reset_flag) | |
| } | |

<Version 4: Configuration where Decoding of acelp_core_ mode is Selectable without Addition of a New Flag> lpd_mode_table is revised as follows. The revision aims at reconstruction of the table according to the coding method. Therefore, using all mode information in the super frame, the table is reconstructed by grouping and sequentially arranging a mode including only the ACELP coding, a mode including both the ACELP coding and the TCX coding, and a mode including only the TCX coding. For this, herein, new_lpd_mode is newly defined. An example of the reconstructed table is shown below.

| | mod[ ] entries based on frames in super-frame | | | | |
|---|---|---|---|---|---|
| New_lpd_mode | frame 0 | frame 1 | frame 2 | frame 3 | Explanation |
| 0 | 0 | 0 | 0 | 0 | All ACELP frame |
| 1 . . . 20 | mod[0] | mod[1] | mod[2] | mod[3] | mod[x] = 0, 1, and 2 |
| 21 | 1 | 1 | 1 | 1 | All TCX256 frame |
| 22 | 1 | 1 | 2 | 2 | |
| 23 | 2 | 2 | 1 | 1 | |

-continued

| | mod[ ] entries based on frames in super-frame | | | | |
|---|---|---|---|---|---|
| New_lpd_mode | frame 0 | frame 1 | frame 2 | frame 3 | Explanation |
| 24 | 2 | 2 | 2 | 2 | All TCX512 frame |
| 25 | 3 | 3 | 3 | 3 | All TCX1024 frame |
| 26 . . . 31 | | | | | reserved |

The table may be defined using syntax as follows. The ACELP bit allocation information is read by reading acelp_core_mode only when New_lpd_mode is 21 or greater, thus performing the decoding. Accordingly, the decoding apparatus may be simplified.

| Syntax | No. of bits |
|---|---|
| lpd_channel_stream( ) | |
| { | |
| new_lpd_mode | 5 |
| if(new_lpd_mode < 21 ) | |
| acelp_core_mode | 3 |
| first_tcx_flag=TRUE; | |
| k = 0; | |
| if (first_lpd_flag) { last_lpd_mode = 0; } | |
| while (k < 4) { | |
| if (mod[k] == 0) { | |
| acelp_coding(acelp_core_mode); | |
| last_lpd_mode=0; | |
| k += 1; | |
| } | |
| else { | |
| tcx_coding( lg(mod[k], last_lpd_mode) , first_tcx_flag); | |
| last_lpd_mode=mod[k]; | |
| k += 2^(mod[k]-1); | |
| first_tcx_flag=FALSE; | |
| } | |
| } | |
| lpc_data(first_lpd_flag) | |
| } | |

The suggested method for decoding an audio signal or speech signal includes analyzing a new LP coding mode (new_lpd_mode) reconstructed according to a coding sequence, determining whether to read the ACELP coding mode according to a value of the new LP coding mode, reading the ACELP coding mode when necessary, and decoding according to the determined ACELP coding mode and new_lpd_mode.

A method for reducing used bits using redundancy of acelp_core_mode and lpd_mode along with the abovementioned structure will be introduced. For this purpose, the aforementioned new_lpd_mode table may be classified into four groups as follows, thereby defining a subordinate lpd_mode table as shown below.

| subordinate new_lpd_mode (sub_new_lpd_mode) | Contents | Meaning |
|---|---|---|
| New lpd_mode_0 | New_lpd_mode = 0 (All ACELP frame) | The whole super-frame includes only ACELP. |
| New lpd_mode_1 | New_lpd_mode = 1~20 | ACELP mode and TCX mode are mixed in the super-frame. |
| New lpd_mode_2 | New_lpd_mode = 21~24 All TCX frame with 256 and 512 | Super-frame including only TCX256 and TCX512. |
| New lpd_mode_3 | New_lpd_mode = 25 (All TCX 1024 frame) | The whole super-frame includes only TCX1024. |

<Version 5: Method for Reducing Number of Bits by Defining a New Mode>

Basically, lpd_mode uses 5 bits. However, actually 26 cases are applicable and 6 cases remain reserved. Since mode 6 and mode 7 are used very rarely in acelp_core_mode, a new mode may be defined instead of mode 6 and mode 7, so that the bits are additionally reduced. Since acelp_core_mode needs to be newly defined, name revision is required. For discrimination from the aforementioned acelp_core_mode, temporal_core_mode will be used, of which meaning may be redefined as follows. The newly defined temporal_core_mode includes a mode frequently used in acelp_core_mode, and a mode frequently used in the subordinate new_lpd_mode. A mode is allocated in an example as follows. When temporal_core_mode is 0 to 5, new_lpd_mode_0 corresponding to the subordinate new_lpd_mode (sub_new_lpd_mode) and new_lpd_mode corresponding to new_lpd_mode_1 are selectable. This is defined as new_lpd_mode_01. Since a total of 21 elements have new_lpd_mode_01, a maximum usable bit for coding is 5 bits. The new_lpd_mode_01 means 21 cases of new_lpd_mode 0 to new_lpd_mode 20. Various coding methods may be applied to code the 21 cases. For example, additional bit reduction may be achieved using entropy coding. In addition, new_lpd_mode selectable when temporal_core_mode is 6 corresponds to new_lpd_mode_2. Coding by 2 bits is available for 4 cases from 21 to 24. Also, new_lpd_mode selectable when temporal_core_mode is 7 corresponds to new_lpd_mode_3. Since the new_lpd_mode is limited to 25, bit allocation is unnecessary.

| Condition of Temporal_ core_mode | Selectable New_lpd_mode | Meaning | Temporal_core_mode & new_lpd_mode Encoding bits |
|---|---|---|---|
| 0~5 | 0~20 | Used ACELP_core_mode is 0 to 5, indicating a frame including only ACELP and both ACELP and TCX. | Temporal_core_mode = 3 bits, New lpd_mode_01 = 5 bits |
| 6 | 21~24 | Super-frame including only TCX256 and TCX512 | Temporal_core_mode = 3 bits, New lpd_mode_02 = 2 bits |
| 7 | 25 | Only TCX1024 frame is allocated in a conventional system. (when ACELP is not available) | Temporal_core_mode = 3 bits, No bit is needed for new_lpd_mode |

Syntax using the above defined table may be configured as follows.

| Syntax | No. of bits |
|---|---|
| lpd_channel_stream( ) | |
| { | |
| Temporal_core_mode | 3 |
| if(Temporal_core_mode == 6 ){ | |
| New_lpd_mode_2 | 2 |
| New_lpd_mode= New_lpd_mode_2+21;} | |
| else if(Temporal_core_mode == 7){ | |
| New_lpd_mode = 25;} | |
| Else{ | |
| New_lpd_mode_01 | 5 |
| New_lpd_mode=New_lpd_mode_01;} | |
| first_tcx_flag=TRUE; | |
| k = 0; | |
| if (first_lpd_flag) { last_lpd_mode = 0; } | |
| while (k < 4) { | |
| if (mod[k] ==0) { | |
| acelp_coding(acelp_core_mode); | |
| last_lpd_mode=0; | |
| k += 1; | |
| } | |
| else { | |
| tcx_coding( lg(mod[k], last_lpd_mode) , first_tcx_flag); | |
| last_lpd_mode=mod[k]; | |
| k += 2^(mod[k]-1); | |

-continued

| Syntax | No. of bits |
|---|---|
| first_tcx_flag=FALSE; | |
| } | |
| } | |
| lpc_data(first_lpd_flag) | |
| } | |

The suggested method for decoding an audio signal or speech signal may include analyzing a temporal_core_mode reconstructed by allocating a subordinate new_lpd_mode having a high availability instead of a low availability mode in the ACELP coding mode, reading the ACELP coding mode and the subordinate new_lpd_mode according to the selected temporal_core_mode, determining the ACELP coding mode and the new_lpd_mode using the read ACELP coding mode and the subordinate new_lpd_mode, and performing decoding according to the determined ACELP coding mode and the new_lpd_mode.

<Version 6: Configuration Maintaining Even a Low Availability Mode>

Version 5 as described above allocates the subordinate new_lpd_mode to a low availability mode. However, even low availability modes may be all maintained by a following method. First, when the mode 6 and the mode 7 of the acelp_core_mode are used, a total of 8 modes are used and 3 bits are necessary. In this case, frame_mode is applied to allocate the subordinate groups of the new_lpd_mode. The frame_mode is coded by 2 bits and each frame_mode has a meaning shown in a table below.

| Frame_mode (2 bits) | Meaning | Acelp_core_mode & new_lpd_mode Encoding bits |
|---|---|---|
| 0 | New_lpd_mode = 0 (All ACELP frame) | acelp_core_mode = 3 bits New_lpd_mode_0 = 0 bits |
| 1 | New_lpd_mode = 25 (ALL TCX 1024 frame) | acelp_core_mode = 0 bits New_lpd_mode_3 = 0 bits |
| 2 | New_lpd_mode = 21~24 All TCX frame with 256 and 512 | acelp_core_mode = 0 bits New_lpd_mode_2 = 2 bits |
| 3 | New_lpd_mode = 1~20 | acelp_core_mode = 3 bits New_lpd_mode_1 = 5 bits |

Here, the subordinate new_lpd_mode is selected according to the frame_mode. The used bit is varied according to each subordinate new_lpd_mode. Syntax using the above defined table is constructed as follows.

| Syntax | No. of bits |
|---|---|
| lpd_channel_stream( ) | |
| { | |
| Frame_mode | 2 |

-continued

| Syntax | No. of bits |
|---|---|
| if(Frame_mode == 0){ | |
| New_lpd_mode = 0; | |
| Acelp_core_mode) | 3 |
| else if(Frame_mode == 1){ | |
| New_lpd_mode = 25;} | |
| else if(Frame_mode == 2){ | |
| New_lpd_mode_2 | 2 |
| New_lpd_mode = New_lpd_mode_2 + 21;} | |
| else{ | |
| New_lpd_mode_1 | 5 |
| Acelp_core_mode | 3 |
| New_lpd_mode=New_lpd_mode_1+1;} | |
| first_tcx_flag=TRUE; | |
| k = 0; | |
| if (first_lpd_flag) { last_lpd_mode = 0; } | |
| while (k < 4) { | |
| if (mod[k] == 0) { | |
| acelp_coding(acelp_core_mode); | |
| last_lpd_mode=0; | |
| k += 1; | |
| } | |
| else { | |
| tcx_coding( lg(mod[k], last_lpd_mode) , first_tcx_flag); | |
| last_lpd_mode=mod[k]; | |
| k += 2^(mod[k]-1); | |
| first_tcx_flag=FALSE; | |
| } | |
| } | |
| lpc_data(first_lpd_flag) | |
| } | |

The suggested method for decoding an audio signal or speech signal may include analyzing a frame_mode prepared to allocate the subordinate groups of new_lpd_mode, reading the ACELP coding mode and a subordinate new_lpd_mode corresponding to a selected frame_mode, determining the ACELP coding mode and new_lpd_mode using the read ACELP coding mode and the subordinate new_lpd_mode, and performing decoding according to the determined ACELP coding mode and new_lpd_mode.

Although a few example embodiments have been shown and described, the present disclosure is not limited to the described example embodiments. Instead, it would be appreciated by those skilled in the art that changes may be made to these example embodiments.

Example embodiments include computer-readable media including program instructions to implement various operations embodied by a computer. The media may also include, alone or in combination with the program instructions, data files, data structures, tables, and the like. The media and program instructions may be those specially designed and constructed for the purposes of example embodiments, or they may be of the kind well known and available to those having skill in the computer software arts. Accordingly, the scope of the invention is not limited to the described embodiments but defined by the claims and their equivalents.

The invention claimed is:

1. An apparatus for decoding a digital audio or a digital speech signal, the apparatus comprising:

a processor that:

checks a flag indicating whether decoding of a current frame is possible without referring to information on previous frames, from a bitstream including at least one of the digital audio signal and the digital speech signal;

determines whether the current frame is encoded in a linear prediction domain (LPD) or a frequency domain (FD), based on a coding mode of the current frame;

decodes the current frame without access to the previous frames in the determined domain, when the decoding of the current frame is possible without referring to information on the previous frames, from the flag;

decodes the current frame with access to the previous frames in the determined domain, when the decoding of the current frame requires information on the previous frames, from the flag; and generates a reconstructed audio or speech signal from the digital audio signal or the digital speech signal based on the decoded current frame, for audio or speech reproduction.

2. The apparatus of claim 1, wherein the flag and the coding mode are assigned to each frame.

3. The apparatus of claim 1, wherein the processor sets context reset information to 1, if the decoding of the current frame is possible without referring to information on the previous frames.

4. The apparatus of claim 1, wherein the processor reads context reset information, if the decoding of the current frame is impossible without referring to information on the previous frames.

5. The apparatus of claim 3, wherein the processor performs context reset, if the context reset information is set to 1.

6. The apparatus of claim 1, wherein the processor sets context reset information to 1 and to perform transform coded excitation (TCX) decoding, if the decoding of the current frame is possible without referring to information on the previous frames.

7. The apparatus of claim 1, wherein the processor reads context reset information and to perform transform coded excitation (TCX) decoding, if the decoding of the current frame is impossible without referring to information on the previous frames.

8. The apparatus of claim 6, wherein the processor performs context reset, if the context reset information is set to 1.

* * * * *